US006041708A

United States Patent [19]

Kipphan et al.

[11] Patent Number: 6,041,708

[45] Date of Patent: Mar. 28, 2000

[54] PROCESS AND APPARATUS FOR CONTROLLING THE INKING PROCESS IN A PRINTING MACHINE

[75] Inventors: Helmut Kipphan, Schwetzingen; Gerhard Löffler, Walldorf, both of Germany; Guido Keller, Zürich; Hans Ott, Regensdorf, both of Switzerland

[73] Assignees: Heidelberger Druckmaschinen Atkiengesellschaft, Heidelberg, Germany; Gretag Atkiengesellschaft, Regensdorf, Switzerland

[21] Appl. No.: 08/293,936

[22] Filed: Aug. 22, 1994

Related U.S. Application Data

[63] Continuation of application No. 07/915,751, Jul. 21, 1992, abandoned, which is a continuation of application No. 06/939,966, Dec. 10, 1986, abandoned.

[30] Foreign Application Priority Data

Dec. 10, 1985 [CH] Switzerland ..... 5262/85

[51] Int. Cl.[7] ..... B41M 1/14; B41F 31/02

[52] U.S. Cl. ..... 101/365; 101/364; 101/211; 101/DIG. 45; 101/DIG. 46

[58] Field of Search ..... 101/365, DIG. 45, 101/DIG. 47, 350, 364, 335, 202, 210, 211, 483; 356/402

[56] References Cited

U.S. PATENT DOCUMENTS

| | | | |
|---|---|---|---|
| 3,958,509 | 5/1976 | Murray et al. . | |
| 3,995,958 | 12/1976 | Pfahl et al. . | |
| 4,076,421 | 2/1978 | Kishner . | |
| 4,185,920 | 1/1980 | Suga . | |
| 4,200,932 | 4/1980 | Schramm et al. . | |
| 4,256,131 | 3/1981 | De Remigis . | |
| 4,403,866 | 9/1983 | Falcoff et al. . | |
| 4,439,038 | 3/1984 | Mactaggart . | |
| 4,494,875 | 1/1985 | Schramm et al. . | |
| 4,505,589 | 3/1985 | Ott et al. | 356/402 |
| 4,541,336 | 9/1985 | Bernauer . | |
| 4,649,502 | 3/1987 | Keller et al. | 364/402 X |
| 4,660,159 | 4/1987 | Ott . | |
| 4,665,496 | 5/1987 | Ott . | |

FOREIGN PATENT DOCUMENTS

| | | |
|---|---|---|
| 1206803 | of 1986 | Canada . |
| 1199521 | 1/1986 | Canada . |
| 99439 | of 0000 | Germany . |
| 227 094 | 8/1973 | Germany . |

OTHER PUBLICATIONS

The International Commission on Illumination Publication (Supp No. 2 to CIE Publication No. 15 (E–1.3.1) 1971/(TC–1.3.) 1978.

(List continued on next page.)

*Primary Examiner*—Kimberly Asher
*Attorney, Agent, or Firm*—Burns, Doane, Swecker & Mathis, LLP

[57] ABSTRACT

To improve the control of the inking process in an offset printing machine, color measuring fields provided on printed sheets are evaluated not as heretofore densitometrically but colorimetrically by means of spectral measurements. Spectral reflections are used to match colors, or color coordinates are calculated from them and compared with corresponding set reflections or set color coordinates. The color deviations obtained in this manner are used to control the inking process. For the stabilization of printing runs the spectral reflections are converted into filter color densities and the inking process is controlled on the basis of these color densities in a conventional manner. The control of the inking process using color deviations and control using color density may be superposed upon each other.

The process makes it possible to adapt color impressions in delicate locations of importance for the image in the print to the corresponding locations of the proof. Color deviations due to different material properties and other error sources may also be equalized to some extent.

26 Claims, 3 Drawing Sheets

OTHER PUBLICATIONS

International Organization for Standardization Publication 5/3–1984.

The Heidelberg Speedmaster—Heidelberg M–Offset (Remote Control Technology CPO 1–02.

"Specification and Control of Process Color Images By Direct Colorimetric Measurement"; Mason, Robert P., TGA Proceedings 1985; pp. 526–548.

"Spectrodensitometry: A New Approach To Color Image Analysis"; McCamy, C.S.: TOKYO Symposium 1977 On Photo. & Electro. Imaging; Sep. 26–30, 1977.

"Control of a Four–Color Lithographic Press by Monitoring the Hue Consistency of the Reproduction with a Densitometer", Hashimoto.

KfK–PDV 177 "Mikrorechner–Regelsystem For Den Farbluse Von Bogenoffset Maschinen", Steiner et al.

PROCESS AND APPARATUS FOR CONTROLLING THE INKING PROCESS IN A PRINTING MACHINE

This application is a continuation of application U.S. Ser. No. 07/915,751, filed Jul. 21, 1992, now abandoned, which is a Continuation application of U.S. Ser. No. 06/939,966, filed on Dec. 10, 1986, now abandoned.

BACKGROUND OF THE INVENTION

The invention concerns a process for the control of inking in a printing machine, a printing plant suitable for the carrying out of the process and a measuring apparatus for the generation of the control data for such a printing plant.

In continuous printing the control of inking is the most important possibility of affecting the impression of the image. It is performed by visual evaluation or by means of a densitometric analysis of color measuring fields printed with the image. An example of the latter is described in German Patent Publication OS 27 28 738.

It has been discovered in actual practice that the control of inking on the basis of densitometric measurements alone is often insufficient. Thus, it happens frequently that in the case of a setting for equal full-tone densities, appreciable color differences appear between proofs or proof substitutes, respectively, and production runs. These perceived color differences must then be corrected manually by the interactive adjustment of the ink controls. The causes of such differences in printed color may be found in the generally different production processes for proofs/substitute proofs and for production runs and in the color differences of the materials used. Furthermore, in the case of constant ink density printing, and in particular full-tone density printing, constancy of the ink impression is not assured because variations of the tone value occur as the result of soiling of the rubber blanket or of other effects.

SUMMARY OF THE INVENTION

Accordingly, it is an object of the present invention to improve the control of inking in printing machines so that a higher degree of agreement between the image impression of proofs or proof substitutes and production runs is achieved. It is a further object that production prints remain stable relative to inking. It is a further object that variations in color are recognized.

These objects are attained by a process, a correspondingly equipped printing plant and a measuring apparatus in which spectral reflections from measured test areas are determined and control of the inking process is effected on the basis of these spectral reflections and the colorimetric data derived therefrom. In this manner, the image impressions, even in delicate locations that are important for the image, may be optimally reconciled in production runs with those of proofs or proof substitutes. Color deviations resulting from different value increments and other material and process effects may also be equalized to some extent. The color measurements themselves may be carried out on color test strips printed simultaneously with the images or on suitably selected locations or test areas in the image.

BRIEF DESCRIPTION OF THE DRAWINGS

The invention will become more apparent from the detailed description hereinbelow read in conjunction with the drawings.

DETAILED DESCRIPTION

Figure 1:
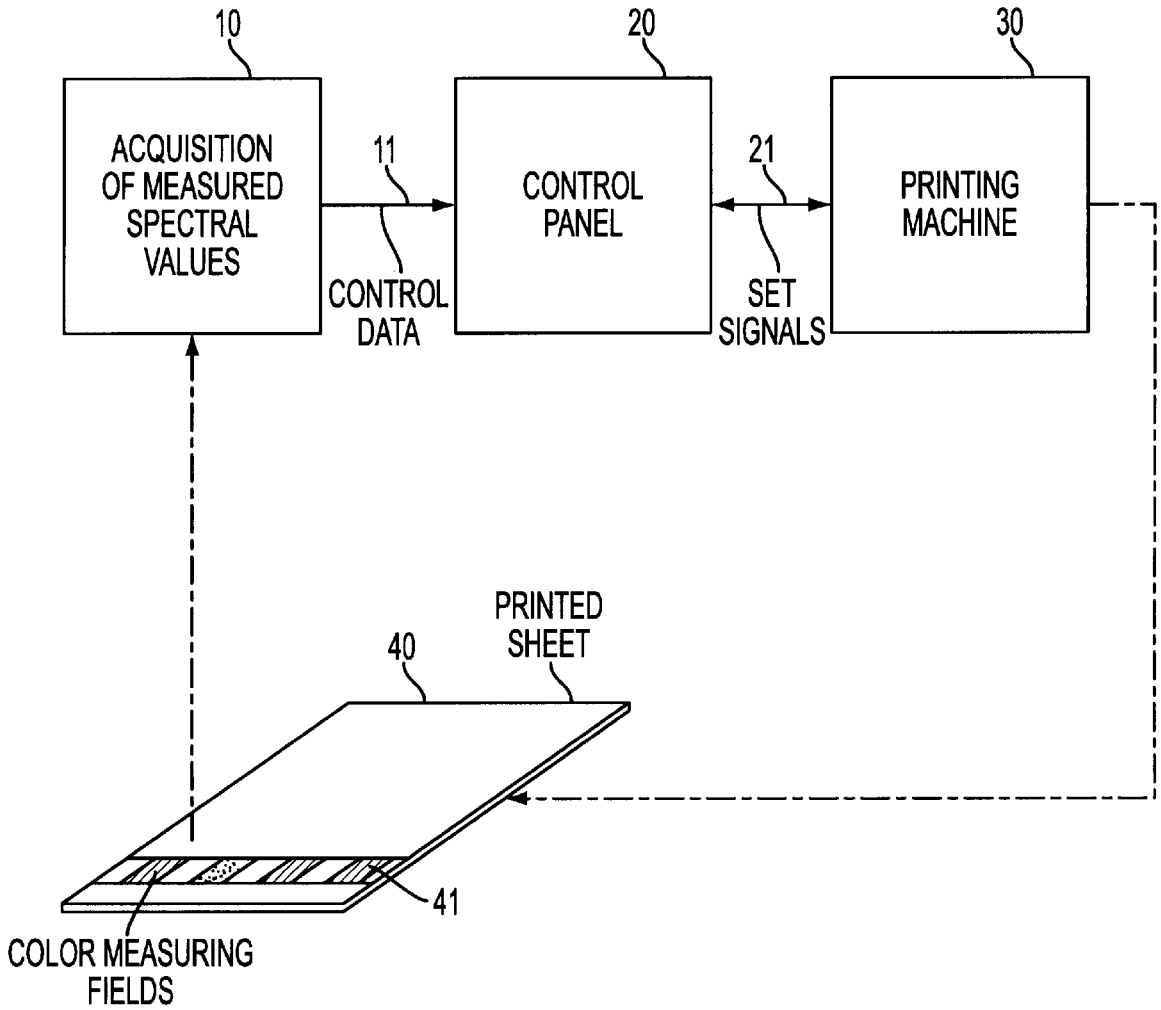
FIG. 1 is a simplified block diagram of a printing plant according to the invention.

In FIG. 1, the printing plant shown corresponds generally to known installations of this type, and comprises a measured value acquisition device 10, a control panel 20 and a printing machine 30 equipped with a remotely controlled ink regulation apparatus.

Printed sheets 40 produced by the printing machine 30 are measured by photoelectric means in a series of test areas, for example in approximate preselected locations in the printed image or in an area of simultaneously printed color measuring fields 41. Control data 11 are determined from the measurements obtained in this manner, said control data corresponding to the color deviations of the printing inks used in printing the individual printing zones. The data 11 are fed into the control panel 20 as input values. The control panel 20 produces from the control data 11 adjusting signals 21 which regulate the ink control elements of the printing machine 30 in a manner such that color deviations are minimized.

Figure 2:
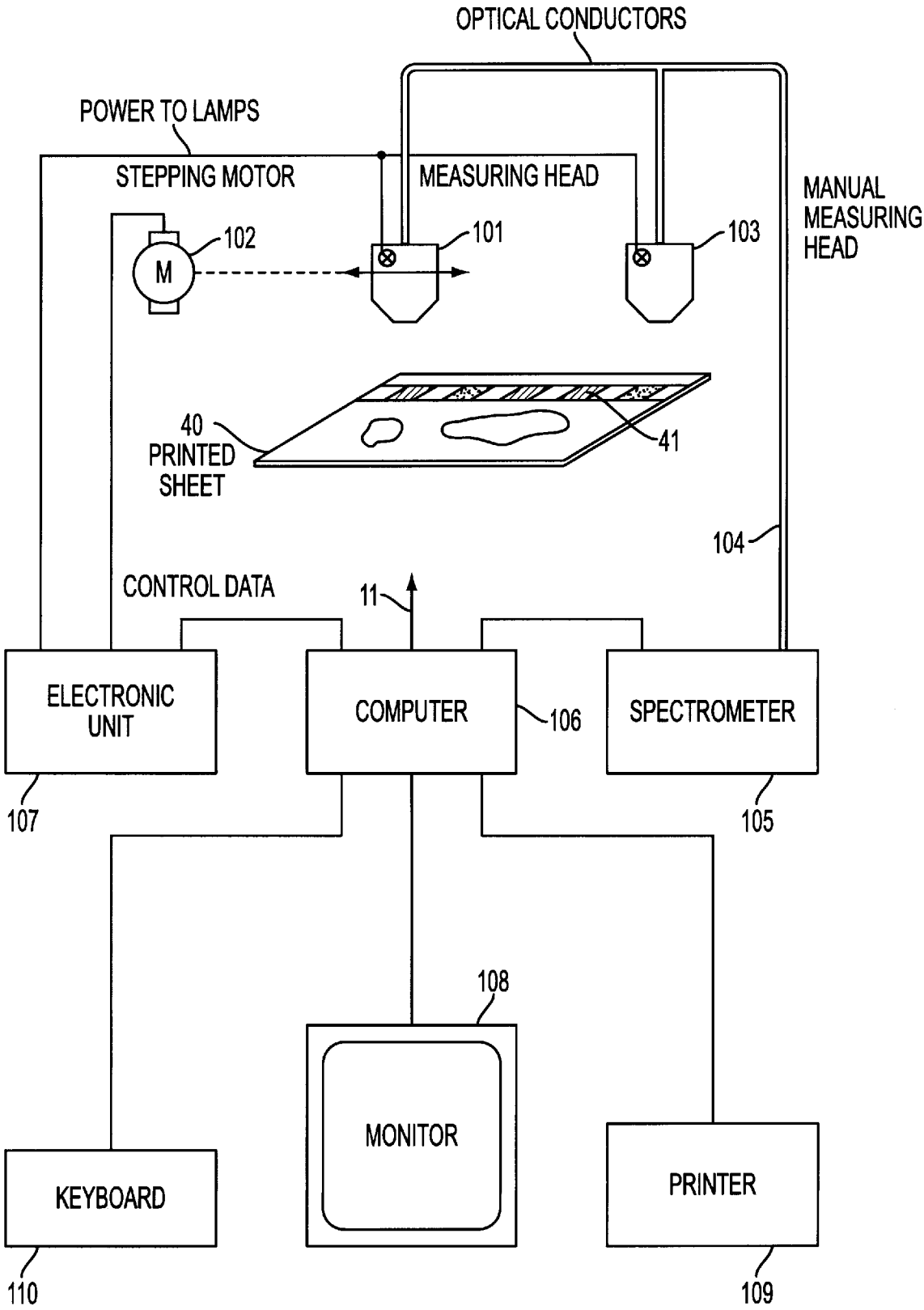
FIG. 2 is a block diagram of the measured value acquisition section of the plant according to FIG. 1

FIG. 2 shows the configuration of the measured value acquisition apparatus. It largely corresponds to the apparatus described in U.S. Pat. No. 4,505,589 so that the following description is concentrated mainly on aspects in accordance with the present invention.

As shown in FIG. 2, the acquisition apparatus 10 comprises a measuring head 101 which is movable, for example by means of a stepping motor 102, relative to the printed sheet 40 to be measured. A manually moveable measuring head 103 is additionally provided; the head 103 may be positioned manually on the desired test area of the printed sheet. The two measuring heads 101 and 103 contain a measuring device, not shown, which illuminates the test area, captures the light reflected by the test area at 90° and couples it into an optical conductor 104 which guides the reflected light to a spectrometer 105. The illumination of the test area may be provided at the customary angle of 45° and it will also be understood that the reflected light may alternatively be conducted to the spectrometer by appropriate means other than the conductor 104.

The spectrometer 105 spectrally decomposes and measures the measured data obtained in this manner are conducted to a computer 106 which as explained in more detail below, determines the control data 11 for the control panel 20. As already known, the computer 106 also controls an electronics unit 107 for driving the stepping motor 102, powering the light sources in the measuring heads 101 and 103 and controlling a data display device 108, a printer 109 and a keyboard 110. An important aspect of the measured value acquisition apparatus 10 according to the present invention is that spectral analysis of the test areas is used for colorimetric analysis, while the known densitometric apparatus merely measures the opacity of the test area. The known apparatus thus does not perform true color measurements/colorimetry. Another important aspect of the present invention relates to the evaluation of the spectral measurement data in the control of the inking process.

Figure 3:
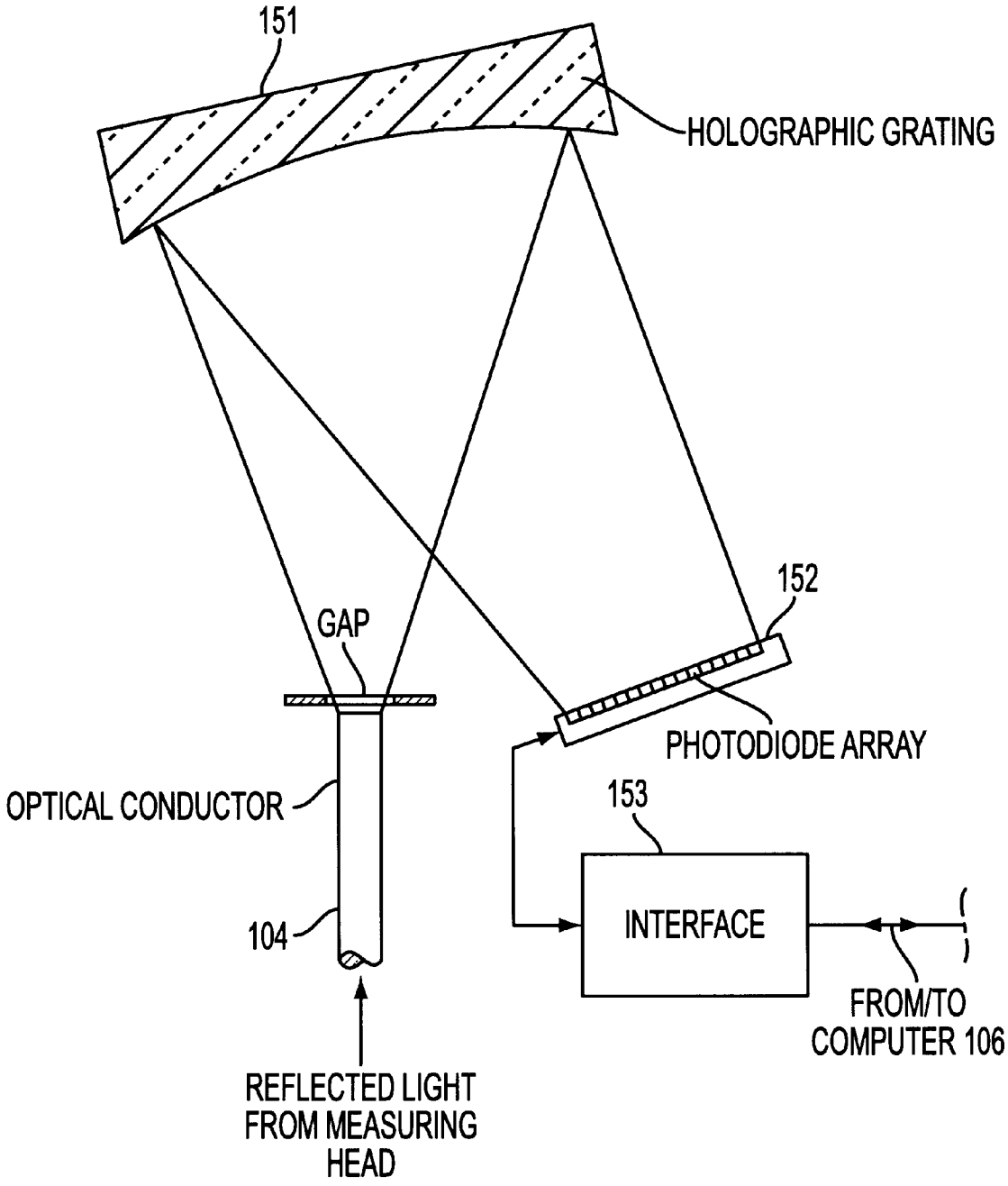
FIG. 3 is a schematic diagram of a detail of FIG. 2.

FIG. 3 shows a known configuration of the spectrometer 105. The measuring light conducted by the optical conductor 104 or other appropriate means from one of the measuring heads 101 and 103 enters the spectrometer through an inlet gap, and illuminates a holographic grating 151. The light is thus spatially divided according to its wavelength. The light spectrally decomposed in this manner is incident on a linear array of photodiodes 152 in a manner such that each photodiode is exposed to an individual, relatively narrow wavelength range. For example, the array may include 35 diodes. The measuring signals produced by the 35 photodiodes thus correspond to a 35-point spectral distribution of the measuring light. An interface unit 153 amplifies and digitizes the measured signals output from the diodes 152, thereby bringing them into a form intelligible to the computer 106. It will be understood that the interface unit 106 could also be located in the computer 106.

The measured value acquisition apparatus 10, the control panel 20 and the printing machine 30 are linked in a closed-loop control circuit. In the systems known heretofore, regulation of the inking process has been carried out accordingly to densitometric, i.e. opacity, measurements of the printing colors involved. If there are deviations from the corresponding set density values, they are regulated out by the control panel through a corresponding adjustment of the ink control elements, i.e. the deviations are nullified or reduced to a permissible tolerance range. The control of the inking process is thus based on color density, but for the aforementioned reasons, this known method of inking control is not always fully satisfactory.

According to the present invention, the principle of inking controls regulated solely by color density is abandoned and replaced by regulation of inking controls based on spectral color measurements and colorimetry. For each test area (for example each color measuring field) the spectral reflection is determined by spectral measurements and optionally by converting the reflection color values of a selected color coordinate system, and calculating and comparing with the corresponding set reflection or set color values. The inking process is then controlled by the deviations of the spectral reflections or color values from the set reflections or values and not by deviations of mere color densities. Preferably, the control is effected with the requirement that the total deviation of a printing zone resulting from the sum of the deviations at each color value should be minimal. Also optionally each test area and correspondingly its color deviation may be taken into account with each test area's deviation given an individual weighting.

Controls effected by means of color coordinates is described below. Regulation by spectral reflections is carried out fundamentally in a similar manner.

The color coordinate system upon which color measurements are based is in itself arbitrary. Preferably, however, the L*a*b* system or the L*u*v* system of CIE (Commission Internationale de l'Eclairage) is used. The color position is defined hereinafter as the coordinate triplet. (L*, a*, b*) or (L*, u*, v*) and the color deviation is given by the vectors $\Delta E_{Lab}$ or $\Delta E_{Luv}$ or the individual vectors (ΔL*, Δa*, Δb*) or (ΔL*, Δu*, Δv*). The set values of the color coordinates, i.e. the set color positions, for the individual test areas are fed into the measured value acquisition-apparatus 10; for example the set values may be manually input by means of the keyboard 110. It is, however, simpler and more convenient to measure the proof, substitute proof or whatever else is to be used as the reference image with the present apparatus itself and to input the measured values or the data calculated from them as the corresponding set values, storing them in a memory. The same is true for the color density set values used in connection with the superposed, density dependent controls to be described further below.

For reasons of easier comprehension on the one hand and compatibility with existing printing equipment on the other, the entire control system is distributed for description over the two components of the measured value acquisition apparatus 10 and the control panel 20. The control signals 11 generated by the measured value acquisition apparatus 10 in accordance with the present invention are of the same nature as those used in the already known color density measuring devices, so that the measured value acquisition apparatus 10 may be connected directly with the aforementioned known control panel 20. Thus, only the measured value acquisition apparatus needs to be replaced to refit a suitable printing plant for the process according to the present invention. It will be understood, however, that it is readily possible to generate directly the set signals needed for eliminating the color deviations from the color deviation calculated by the measured value acquisition apparatus without producing compatible control signals, and to combine the necessary electric circuits in another appropriate manner or to integrate them into a single apparatus. The division of the control system described below should therefore be understood merely as an example, although it is very close to that used in actual practice.

The computer 106, as mentioned above, calculates for every test area the color deviation vector $\Delta E_n$. Each of these vectors $\Delta E_n$ is then weighted with a weight factor $g_n$, so that each of the test areas may be considered individually. Test areas typical of the image will be given greater weights, while those of lesser importance will be weighted less.

It is also possible to eliminate weighting and to treat all of the test areas equally, or to include from the beginning only certain test areas in the control process. The weight factors also may be entered interactively by means of the keyboard 110 or they may be preprogrammed.

The weighted or optionally non-weighted color deviation vectors of the individual measuring fields are each multiplied mathematically with a transformation matrix which may be determined empirically. By taking into account certain quality criteria a color density variation vector is obtained, the components of which consist of the density variations or layer thickness variations of the printing colors involved in the printing. The color density variation vector therefore represents the control data for the printing zone under consideration and acts to alter the setting of the ink control elements so that the total color deviation—determined as the sum of the contributions or the sum of the squares of the individual color deviations—will be at a minimum. This total color deviation may also serve as a quality measure for the print.

The elements of the transformation matrices are essentially the partial derivatives of the color coordinates from the color densities of the printing inks involved. They may be determined either empirically by measurements of corresponding test prints or synthetically by modelling.

For three-color printing the density variation vector has three components and its calculation from the color deviation vectors which also have three components is relatively uncomplicated. In a case of more than three printing colors, the contributions of the individual test areas must be correlated logically in a suitable manner with the individual components of the density variation vector so that a correspondingly multi-dimensional variation vector is obtained.

As mentioned above, the set signals for the ink control elements may also be determined directly from the color deviations. Here again, the appropriate procedure is based on the criterion that the total color deviation must be minimized. As before, it is again possible to apply differential weights to the individual test areas.

The printing process is usually carried out in three phases. The first phase consists of the more or less rough presetting of the printing machine, for example based on the measured values of printing plates. This is followed by the so-called setup phase (fine setting, register) wherein the ink controls are adjusted using the proofs or proof substitutes in one way or another until the printed product is satisfactory. Finally, the third phase is the printing run, in which the intent is to adjust the controls so as to maintain the result obtained by the setup phase as constant as possible. Customarily the reference used for this is not the proof or the like, but a printed sheet found to be satisfactory, i.e., the so-called OK sheet; the printing run is regulated for constant densitometrically determined color densities.

The density regulation phase in printing runs may be carried out in a very simple manner by the printing plant according to th e present invention. It is merely necessary to convert t he measured spectral reflections to filter color densities corresponding to a densitometer and then to compare them with the set color density values determined from an OK sheet. The differences between the measured and the set color densities then immediately represent the control data 11 for the control panel 20.

According to an advantageous embodiment of the process according to the present invention the printing machine may be set up as described using color deviation controls while the printing run is stabilized in the conventional manner using color densities. A particular advantage of this embodiment is that the determination of color densities may be based on arbitrary filter characteristics, whereby a high degree of flexibility of the plant is obtained.

According to an other advantageous embodiment, the two control principles may be superposed upon each other, that is, during printing run stabilization controlled by means of color densities, the total color deviation is also determined and monitored. If the overall color deviation should exceed for some reason (for example variations of the printing process due to rubber blanket contamination, etc.), a predetermined limiting value, a suitable reaction may be invoked. For example, a new color-deviation-controlled correction of the printing machine may be carried out, whereby simultaneously the set color density values are updated for further printing run stabilization; it is also possible to produce merely an indication of printing error.

The total color deviation may be considered a measure of quality and optionally displayed or printed out.

An important element of standardized print monitoring is the color measuring strip. The raster tones are to appear adapted to different color and tone value combinations or to particularly critical tones. It is also possible to include critical tones from the subject image into the measuring strip.

Experience shows that subjects may divided into groups as a function of color, for example furniture catalogs (the quality of which is determined by brown tones), cosmetics prospectuses and portraits, in which skin tones are dominant. There are also groups in which for example gray or green tones are prevalent. Correspondingly, specific color-oriented color measuring strips may be constructed and purposefully applied. In this manner, the image-determining areas may be taken into account in a simple manner.

In proof or proof-substitute printing, controls are not always based on zones. It is sufficient in this case to print simultaneously one measuring field of each field type and to establish these as set values for the entire width of the printed sheet or parts thereof.

On a production printed sheet with zonal ink control each zone may be monitored individually. Measuring fields important for ink control, such as single color measuring fields for the density controlled regulation of the inking process and multicolor halftone fields for colorimetric regulation, must therefore be repeated with the closest possible spacing. Control fields for ink uptake, tone value increments, etc. may be mounted at somewhat larger distances.

In three-color printing the printable color space is limited by the color positions of paper white, the single-color full tones and the 2- and 3-color full-tone overprints (white, cyan, magenta, yellow, red, green, blue, black). Although not all color deviations may be equalized simultaneously in all color tones during printing, it is possible to optimize the mean color deviations. It is therefore convenient to use, in addition to colo-density-controlled regulation for the color-deviation-controlled ink control, suitable 2- or 3-color halftone fields, such as gray balance fields or subject-dependent delicate tones.

In four-color printing, blackening is produced by 3 colors and/or by black. As measuring fields for color-position-controlled regulation, halftone fields with black or 2 or 3 colors may also be of interest. Color tones are chosen preferably from critical areas of the printing space. If four-color halftone fields are used, one color must be predetermined as a free parameter and measured additionally on a separate color measuring field.

For special colors, suitable color measuring fields may be determined in keeping with similar considerations and depending on the subject.

The principles, preferred embodiments and modes of operation of the present invention have been described in the foregoing specification the invention which is intended to be protected herein, however, is not to be construed as limited to the particular forms disclosed, since these are to be regarded as illustrative rather than restrictive. Variations and changes may be made by those skilled in the art without departing from the spirit of the invention.

We claim:

1. Process for controlling ink feed in a printing machine comprising the steps of:

spectrophotometrically measuring a printed sheet printed by the machine in at least one test area to obtain spectrophotometric data of said test area;

determining from said spectrophotometric data a color position of said test area relative to a selected color coordinate system;

determining a desired reference color position relative to said selected color coordinate system for a reference test area;

determining a color deviation of said test area with respect to said reference test area in terms of a difference between the color position of said test area and the reference color position of said reference test area;

converting said color deviation into a corresponding set of standard filter density deviations; and, controlling the ink feed in response to said set of density deviations.

2. Process according to claim 1 wherein a plurality of test areas are spectrophotometrically measured and the color deviations with respect to a corresponding one of a plurality of reference color positions is determined for each test area, further comprising the steps of:

summing all of the color deviations to determine a total color deviation; and, determining from said color deviations said set of density deviations such that said total color deviation is minimized.

3. Process according to claim 2, further including the steps of:

weighting each color deviation by an individual weighting factor, said individual weighting factor being selected in accordance with the importance of the individual test area with respect to a visual impression of a printed image.

4. Process according to claim 2, wherein said step of summing includes summing the squares of all of the color deviations.

5. Process according to claim 1 wherein the printing machine includes a number of printing zones and wherein the ink feed is controlled for each respective printing zone in response to a set of color deviations determined from test areas belonging to each said respective printing zone.

6. Process according to claim 1 wherein after a setup phase during a printing run of the printing machine said set of density deviations is determined directly by:

digitally filtering said spectrophotometric data with selected color filter curves; and, comparing the filtered data with corresponding desired reference data.

7. Process according to claim 6 wherein a plurality of test areas are spectrophotometrically measured and the color deviations with respect to a corresponding one of a plurality of reference color positions is determined for each test area further comprising the steps of:

determining a total color deviation from all of the color deviations during the printing run;

monitoring said total color deviations; and, issuing a warning when a total color deviation tolerance is exceeded.

8. Process according to claim 1 wherein the test area is a simultaneously printed multicolor halftone measuring field.

9. Process according to claim 1 wherein the test area has a color tone corresponding to a selected critical image area of the printed sheet.

10. Printing plant comprising:

an automatically controllable printing machine;

an automatic control means for said printing machine, said control means controlling ink feed of the printing machine in response to input color density deviation signals;

an acquisition means for photoelectrically measuring a test area on a printed sheet printed by said printing machine and for determining from photoelectrically measured data and from desired reference data said input color density deviation signals for said control means;

said acquisition means being equipped for spectrophotometrical measurement of said test area and for converting spectrophotometrical measuring data into color position data;

said acquisition means being further equipped for comparing said color position data with given reference color position data and for determining color deviation data in response to this comparison; and, said acquisition means being further equipped for converting said color deviation data into said input color density deviation signals.

11. Printing plant according to claim 10 wherein the acquisition means is further equipped to convert said spectrophotometrical measuring data into color density data by digital filtering with selected color filter curves and to determine said input color density deviation signals by comparison of said color density data with corresponding reference density data.

12. A process for controlling the inking process in a printing machine comprising the steps of:

(a) establishing desired reference color coordinates in a standardized color coordinate system wherein each coordinate value uniquely defines a particular color;

(b) measuring color spectral characteristics of a test area printed by the printing machine to establish measured color coordinates for said test area in said color coordinate system;

(c) determining a color deviation of said test area on the basis of the reference color coordinates and said measured color coordinates; and (d) controlling the inking process of the printing machine as a function of said color deviation.

13. The process according to claim 12, wherein the standardized color coordinate system is according to one of the CIE recommendations.

14. The process according to claim 12, wherein the step of controlling the inking process includes the step of converting the color deviation into a density deviation and controlling ink feed of the printing machine in response to the density deviation.

15. The process according to claim 14, wherein the step of converting includes the step of empirically determining a plurality of values related to changes in color coordinates as a function of changes in density for a plurality of printed areas.

16. The process according to claim 14, wherein said step of converting further includes a step of:

transforming said color deviation into a density deviation using a transformation matrix of partial derivative elements.

17. The process according to claim 12, wherein the step of establishing desired reference coordinates includes the step of measuring color spectral characteristics of a reference area for establishing the desired reference color coordinates in said standardized color coordinate system in response to said measured color spectral characteristics.

18. Process according to claim 12, wherein said measuring step further includes the step of measuring the color spectral characteristics of a plurality of test areas.

19. Process according to claim 18, wherein said step of determining further includes the step of determining plural color deviations between the color spectral characteristics of said plurality of test areas and corresponding reference color coordinates associated with each of said test areas, such that said inking process is controlled as a function of said plural color deviations.

20. An apparatus for producing inking control signals for a printing machine comprising:

means for establishing desired reference color coordinates in a standardized color coordinate system wherein each coordinate value uniquely defines a particular color;

means for measuring color spectral characteristics of a printed test area to establish measured color coordinates for said test area in said color coordinate system;

means for determining a color deviation of said test area in response to said reference color coordinates and said measured color coordinates; and means for producing inking control signals as a function of said color deviation.

21. Apparatus according to claim 20, wherein the color coordinate system is the L*u*v* coordinate system.

22. Apparatus according to claim 20, wherein the color coordinate system is the L*a*b* coordinate system.

23. Apparatus according to claim 20, wherein said producing means further includes:

means for converting said color deviation into a corresponding set of standard filter density deviations.

24. Apparatus according to claim 20, wherein said measuring means further measures a plurality of printed test areas and said determining means determines color deviations with respect to a corresponding one of a plurality of reference color coordinates associated with each of said test areas, said apparatus for producing inking control signals further including:

means for summing all of said color deviations to determine a total color deviation.

25. Apparatus according to claim 24, wherein said inking control signals are produced by minimizing the color deviations of selected test areas.

26. Apparatus according to claim 24, wherein said inking control signals are produced by minimizing the total color deviation.

* * * * *